US008776686B2

(12) United States Patent
DuBois, III

(10) Patent No.: US 8,776,686 B2
(45) Date of Patent: Jul. 15, 2014

(54) AUTOMATED CUTTING SYSTEM FOR CUSTOMIZED FIELD STENCILS

(76) Inventor: Radford Eugene DuBois, III, Leland, MS (US)

( * ) Notice: Subject to any disclaimer, the term of this patent is extended or adjusted under 35 U.S.C. 154(b) by 222 days.

(21) Appl. No.: 12/982,666

(22) Filed: Dec. 30, 2010

(65) Prior Publication Data

US 2011/0094399 A1 Apr. 28, 2011

Related U.S. Application Data

(60) Continuation of application No. 12/197,122, filed on Aug. 22, 2008, and a division of application No. 11/017,360, filed on Dec. 20, 2004, now abandoned.

(51) Int. Cl.
*B41M 1/12* (2006.01)

(52) U.S. Cl.
USPC ..... 101/129; 101/126

(58) Field of Classification Search
USPC ..... 101/129, 126
See application file for complete search history.

(56) References Cited

U.S. PATENT DOCUMENTS

| | | | | |
|---|---|---|---|---|
| 2,570,806 | A | | 10/1951 | Henry |
| 3,048,093 | A | | 8/1962 | Loro |
| 3,633,286 | A | * | 1/1972 | Maurer ..... 434/87 |
| 4,125,658 | A | * | 11/1978 | Miles ..... 428/131 |
| 4,530,061 | A | | 7/1985 | Henderson et al. |
| 4,832,331 | A | | 5/1989 | Brandli |
| 4,972,323 | A | | 11/1990 | Cauwet |
| 5,186,119 | A | | 2/1993 | Hlavin |
| 5,201,027 | A | | 4/1993 | Casini |
| 5,280,921 | A | | 1/1994 | Milburn |
| 5,444,212 | A | * | 8/1995 | MacNaughton et al. .. 219/121.7 |
| 5,611,036 | A | * | 3/1997 | Berend et al. ..... 345/441 |
| 5,614,115 | A | | 3/1997 | Horton et al. |
| 5,791,215 | A | | 8/1998 | Morrison et al. |
| 5,795,154 | A | * | 8/1998 | Woods ..... 434/87 |
| 5,822,209 | A | | 10/1998 | Fischer |
| 5,901,646 | A | | 5/1999 | Walker |
| 5,910,282 | A | | 6/1999 | Grozdanovski et al. |
| 6,007,230 | A | | 12/1999 | Beckett et al. |
| 6,055,738 | A | * | 5/2000 | Bardeen et al. ..... 33/566 |
| 6,112,425 | A | | 9/2000 | Nelson et al. |

(Continued)

FOREIGN PATENT DOCUMENTS

WO 03/047767 A1 6/2003

OTHER PUBLICATIONS

The Fundamentals of Using MTP One-Piece Stencils: A Step-By-Step Guide; www.missouriturfpaint.com; 2 pages.

*Primary Examiner* — Anthony Nguyen
(74) *Attorney, Agent, or Firm* — Conley Rose, P.C.; Clinton R. Stuart

(57) ABSTRACT

The Automated Cutting System for Customized Field Stencils ("ACSCFS") is a device designed to implement an automated field stencil creation process. The ACSCFS is comprised of a computer system and an automated cutting table, wherein said automated cutting table is further comprised of a cutting surface, an automated means for placing sheet material onto said cutting surface, and an automated cutting implement. The computer analyzes a color logo image and translates it into a line drawing. The drawing is then scaled, and guideline aperture locations are placed along each line. The computer then transmits instructions to the automated cutting table, directing the creation of a field stencil with a dotted guideline hole pattern. Such field stencils allow for the reproduction of multi-color logos using a single stencil.

19 Claims, 4 Drawing Sheets

(56) References Cited

U.S. PATENT DOCUMENTS

| | | | |
|---|---|---|---|
| 6,164,178 | A | 12/2000 | Iattoni et al. |
| 6,178,859 | B1 | 1/2001 | Pomerleau et al. |
| 6,619,172 | B2 | 9/2003 | Nichols et al. |
| 6,766,736 | B2 | 7/2004 | Regner et al. |
| 2001/0012128 | A1 | 8/2001 | Nomura |
| 2002/0075292 | A1 | 6/2002 | Spector |
| 2004/0129121 | A1 | 7/2004 | Plumley |
| 2004/0197548 | A1 | 10/2004 | Kopystecki |

* cited by examiner

AUTOMATED CUTTING SYSTEM FOR CUSTOMIZED FIELD STENCILS

This application is a continuation of and claims benefit under 35 USC §120 to co-pending U.S. patent application Ser. No. 12/197,122 entitled "Automated Cutting System for Customized Field Stencils" filed Aug. 22, 2008, which is a divisional application under 35 USC §121 of and claims priority to U.S. patent application Ser. No. 11/017,360, filed Dec. 20, 2004, and entitled "Automated Cutting System for Customized Field Stencils", all of which are hereby incorporated by reference herein as if reproduced in their entirety.

BACKGROUND OF THE INVENTION

This invention concerns the making of field stencils, for reproducing graphic art logos on athletic fields and such. More particularly, this invention of the Automated Cutting System for Customized Field Stencils concerns a device and process for automating the production of field stencils. In this way, the present invention allows for much more efficient, mass production of field stencils.

Field stencils are essentially sheets of material in which logo patterns are cut, allowing for the reproduction of multi-color logos upon a field (such as an athletic field), or some such other surface. While field stencils are most typically used to reproduce team logos on grass athletic field surfaces, they may be used to reproduce any sort of graphic image on a wide array of surfaces (such as walls, basketball courts, and swimming pools). Examples of such logos are commonly seen displayed at sporting events, such as college and professional football events and NASCAR events. And another common use of field stencils is to reproduce corporate logos. Field stencils differ from more typical stencils in that they allow multi-color logo reproduction using only a single stencil (i.e. a single sheet of material with pattern cut-outs), rather than layering several different stencils together to form a multi color image.

Traditional stencils are each single color stencils, in which each stencil sheet has a cut-away area for a specific color (i.e. the cut-away section in a traditional stencil sheet represents the entire area of the image being recreated which is a particular color). In order to reproduce multi-color images with these traditional stencils (such as those used in U.S. Pat. No. 5,822,209), each stencil is applied one at a time in sequence; once placed, the cut-away section of each stencil is painted with the appropriate color. Once one color has been applied in this manner, the next stencil is put in place, and the appropriate color is applied to the cut-away section. Only after each single-color stencil has been applied and painted in sequence does the multi-color image emerge. Typically, traditional stencils are used to recreate fairly small images where precision is necessary. Thus, traditional stencils are usually used in the printing industry.

Obviously, creating multi-color images using traditional stencils is rather labor intensive. It requires a series of stencils, and the stencils must be applied and painted properly in order for the multi-color image to emerge. Alignment issues are critical, since the stencils must match properly or else the image will not be reproduced properly. The process is also fairly slow and inefficient (since it requires the precise placement of several stencils, along with wait time for the paint to dry between stencil applications). While traditional stencils produce a nice, clear image and work quite well for small reproductions, they do not lend themselves as well to reproduction of larger scale images, such as those necessary for logos being applied to athletic fields.

The larger multi-color images which are reproduced onto athletic fields do not require quite as much precision in reproduction technique, given the nature of the working surface upon which the paint will be applied (i.e. the grass surface lends a certain amount of variability by necessity) and given the manner in which the image will be viewed (by spectators from afar). As a result, field stencils are able to use a different technique for transferring a multi-color logo image using a single stencil. A field stencil does not employ complete cut-outs for the various colors of the design. Instead, field stencils use dotted guidelines, which demarcate the different color zones of the multi-color image. When the field stencil is laid in place on the surface to be painted, it basically looks like a sheet of material with a pattern of small holes (forming guidelines). The user then sprays the appropriate holes with the appropriate colors of paint (i.e. each specific guideline receives a particular color of paint), in order to transfer the dotted guideline image onto the field surface. This dotted guideline image is used to recreate the multi-color logo image.

When the field stencil is removed, the dotted guideline image is in place on the field surface, and is set forth in the appropriate colors. The user then finishes the image by linking the dotted guidelines of each specific color together (using the appropriate color of paint) and filling in the interposing zones with the appropriate colors. In this way, a single field stencil allows for the transfer of a multi-color image. Obviously, using a field stencil is more efficient than using a set of traditional stencils. This is especially true given the issues inherent in creating and painting large stencils.

Field stencils have traditionally been produced by hand. Images have been drawn onto plastic sheets by hand, and then guideline holes have been drawn and cut by hand. More specifically, a graphic image of the logo to be reproduced was typically projected onto the large plastic sheet using an overhead transparency projector. The projected image was then traced onto the plastic sheet. After the plastic sheet was taken down and inspected, the traced image usually had to be corrected, since the projected image was typically somewhat distorted. This required hours of inspection and hand correction. Then, once the corrected traced image was in place on the plastic sheet, the guideline holes were drawn in and cut out by hand. Obviously, such hand production was time consuming and inefficient.

The present invention of the Automated Cutting System for Customized Field Stencils ("ACSCFS") modernizes the production process for field stencils, automating the stencil creation process in order to allow for mass production, while eliminating human error, increasing efficiency, and reducing turn-around-time. The ACSCFS uses a computerized process to convert a multi-color image of the logo (typically provided by the client) into a vector-based line drawing (in which the lines indicate different color regions). The computer then inserts guideline hole markings along each of the lines of the line drawing of the multi-color logo image. Once this information has been encoded, it can be scaled to create a logo of any size (i.e. the stencil size can he set as necessary for the finished product, and may be adjusted for additional runs at different sizes). This information is transmitted from the computer to the automated cutting table, which uses the instructions generated by the computer to cut a field stencil for the provided logo image. By automating the process, the generation of field stencils can be greatly improved.

SUMMARY OF THE INVENTION

The Automated Cutting System for Customized Field Stencils ("ACSCFS") uses an automated process for creating dotted guideline field stencil patterns (in which a single field stencil can be used to recreate a multi-color logo image). A color image of the logo or other graphic design to be depicted is analyzed, using some form of color recognition technology. This color recognition technology transforms the color image into a line drawing, in which different lines represent the boundaries between color zones. The line drawing is scaled appropriately, to provide a stencil sized to produce the desired logo. Then, guideline holes are placed along each such line in the line drawing (since it is these holes that will ultimately be used to mark the logo onto the field using the stencil and paint). The information from the color recognition technology, relating to the line drawings and, specifically, to the guideline hole placement, forms the basis for the cutting pattern instructions.

While this information could be drawn on the stencil sheet material and cut out by hand, preferably the stencil cutting process would be automated as well (since an integrated process that automates the image capture, image translation, and stencil cutting process is more efficient and accurate). The cutting pattern instructions direct the cutting implement of the automated stencil cutting table. The automated stencil cutting table then automatically cuts the field stencil pattern into the stencil medium material, which is usually a sheet of plastic.

Typically, the ACSCFS comprises a computer (usually operating software to perform the necessary ACSCFS functions) and an automated cutting table. The computer receives the original color logo image, translates the color image into cutting instructions to create a field stencil of the appropriate size with dotted guidelines indicating the various color zone boundaries, and transmits the cutting instructions to the automated cutting table in order to control the movements of the cutting implement of the automated cutting table (so that it cuts the appropriate dotted guideline holes in the stencil sheet material in order to generate the appropriate logo pattern).

The automated cutting table typically comprises a storage unit for holding stencil sheet media material (for example, a roller with a roll of sheet plastic mounted on it), a cutting surface, a means for drawing stencil sheet media material from the storage unit onto the cutting surface (for example, a gripper gantry bar), a means for holding the stencil sheet material in place flat and tight against the cutting surface (for example a vacuum pump), and a cutting implement (which is typically mounted on an automated arm, a mechanized gantry, or some other mobile mounting means, and whose movements are directed in accordance with the instructions of the computer). Obviously, the cutting implement must be sufficient to cut through the stencil sheet media material. Preferably, the cutting surface would be quite large, since that would enable a variety of sizes of field stencils to be created, including the creation of large logo images using only one stencil sheet (rather than having to use multiple field stencils, each of which only represented a portion of the logo design). Additional optional elements, such as a plotter pen, may also be included.

It is an object of this invention to improve the creation process for field stencils, by improving the efficiency and accuracy of image reproduction and allowing for mass reproduction. It is another object of this invention to automatically convert a color image of a logo or a graphic design into cutting instructions for creating a field stencil. It is yet another object of this invention to employ color recognition techniques. It is yet another object of this invention to translate a multi-color image into a line drawing. It is yet another object of this invention to delineate color boundary lines. It is yet another object of this invention to place guideline hole indicators along color boundary lines. It is yet another object of this invention to generate cutting pattern instructions based on color boundary lines, in order to create a field stencil with dotted guideline holes for indicating the various color regions of the logo being reproduced.

It is another object of this invention to automatically cut a field stencil in accordance with pre-generated instructions. It is yet another object of this invention to draw stencil sheet media material in preparation for the cutting process. It is yet another object of this invention to hold the stencil sheet media material down onto the table in preparation for cutting. It is yet another object of this invention to automatically cut the stencil sheet media material in accordance with pre-generated cutting instructions, thereby creating a field stencil by forming guideline holes. It is yet another object of this invention to paint a logo or graphic design onto a field surface using a field stencil and appropriately colored paint. These and other objects will be apparent to those skilled in the art field.

BRIEF DESCRIPTION OF DRAWINGS

Reference will be made to the drawings, where like parts are designated by like numerals, and wherein.

DETAILED DESCRIPTION OF PREFERRED EMBODIMENT

The Automated Cutting System for Customized Field Stencils ("ACSCFS") 10 comprises equipment specifically designed to implement an automated process for creating dotted guideline field stencil patterns. Essentially, the ACSCFS 10 comprises an automated cutting table 15 which is controlled by a computer system 20. At its base, though, the automated process is at the heart of the invention, and the physical components are driven by the method for generating cutting instructions (i.e. for creating a field stencil), as well as the manner in which the instructions are to be implemented. Thus, the method for generating cutting instructions will be discussed in detail first, before the preferred embodiment of the device is set forth.

Figure 1:
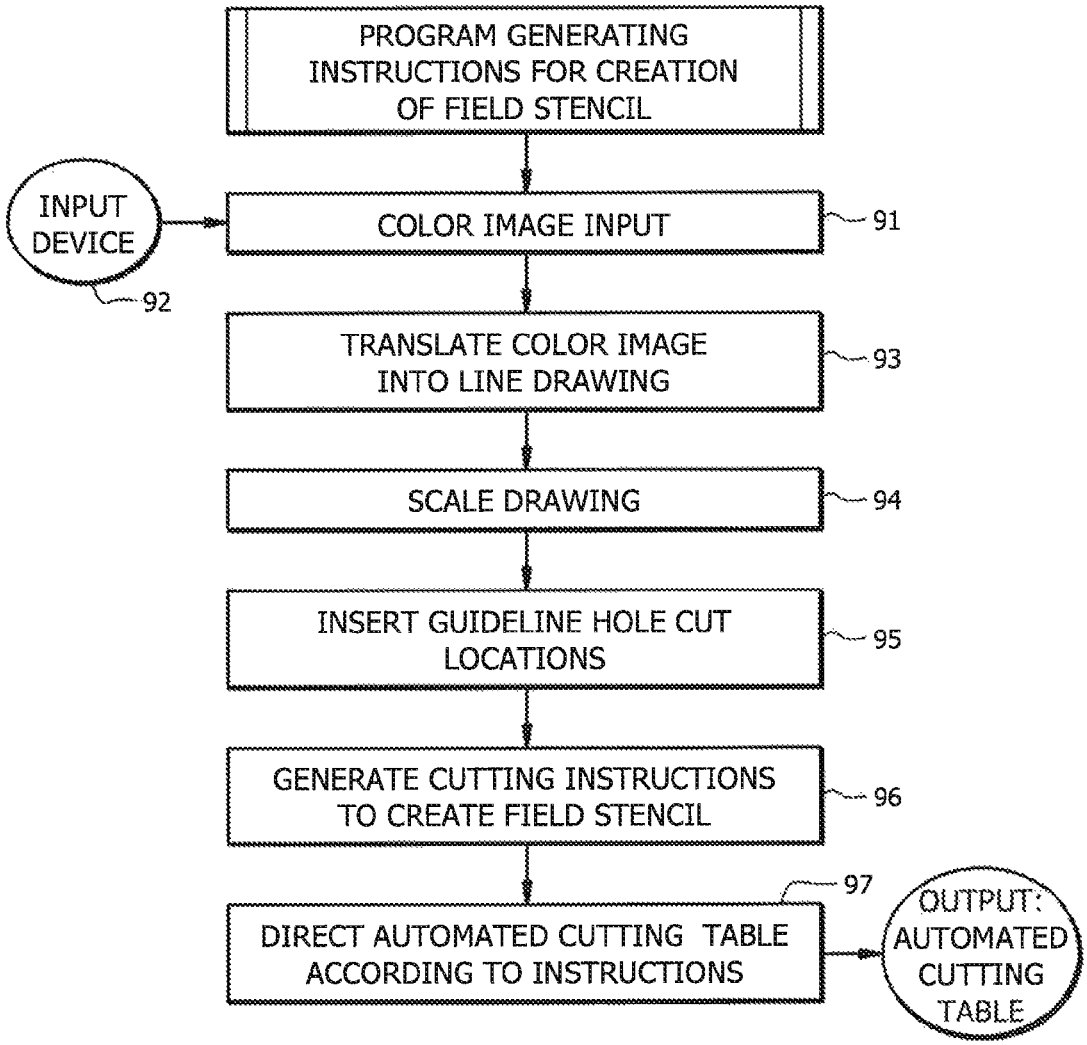
FIG. 1 is a Flowchart showing the preferred process for transforming a color logo image into cutting instructions to produce a field stencil.

FIG. 1 shows a flowchart, which illustrated the preferred embodiment of the method for generating cutting instructions. This process takes a color image (typically a multi-color image) of a logo or other graphic design, and translates the provided image into instructions which will define the manner in which to cut a field stencil (for reproducing the color image onto a field, for example). In the first step, shown in box 91, the color image is input into a computer 20. There are many possible means for inputting (box 92) the color image into the computer 20, including but not limited to using a digital camera to take a photograph of a hard copy of the color image and then downloading the digital image file to the computer 20, scanning a hard copy of the color image, or simply e-mailing or otherwise downloading a graphic image file (of the sort the client might create themselves using standard graphic software). In the preferred embodiment, the client typically will send a graphic image file of the color image, since this guarantees the surest image capture.

In the second step, shown in box 93, the color logo image is translated into a line drawing. This conversion process is typically accomplished using some sort of color recognition technology, which identifies the various color regions within the color image and places lines between the identified color regions in order to demarcate transitions from one color to another. In other words, the color image is mapped into a line drawing, where each line represents a color boundary. In the third step, shown in box 94, the line drawing is scaled to the appropriate size, depending upon the final size that the user wishes the logo or graphic image to appear on the field (i.e. the actual size that the field stencil needs to be cut).

The scaling factor may be important in determining the amount of stencil sheet material 80 needed for a particular field stencil. If the stencil will ultimately be smaller than the full length of the cutting surface 40 of the automated cutting table 15, then the scaling factor determines the amount of sheet material 80 pulled out onto the cutting surface 40. On the other hand, it is also possible that the stencil will ultimately be larger than the full length of the automated cutting table cutting surface 40, and the scaling factor helps to account for this possibility as well. While the preferred embodiment of the ACSCFS 10 is designed to allow for the creation of large stencils, in order to allow a single stencil sheet to reproduce most logo/graphic images, it is possible that the user might want a particularly large final logo/graphic image (which is too big to fit on a single stencil sheet; i.e. which is larger than the cutting surface 40). If that is the case, then the scaling information will take this into account, by dividing the logo/graphic image as necessary so that it can be reproduced properly using multiple stencil sheets.

In other words, the scaling factor may require the logo/graphic image to be divided onto two or more stencil sheets. So if scaling makes the logo/graphic image larger than a single stencil sheet (i.e. larger than the total cutting surface 40), the computer 20 will essentially overlay stencil sheet dimensions onto the larger logo/graphic image in order to divide the total logo/graphic image over multiple stencil sheets (by determining the number of stencil sheets needed, as well as which portion of the overall logo/graphic image pattern each stencil sheet will bear). In this way, any size logo/graphic image can be reproduced by using multiple field stencils in conjunction (and typically, the various field stencil pieces would be taped together to form the entire image before use). Obviously, this scaling process could also be performed by the operator (who would determine the number of stencil sheets required and sub-divide the image accordingly).

In the fourth step, shown in box 95, aperture locations for the dotted guideline pattern are placed along each line in the line drawing. Ultimately, the computer 20 will instruct the automated cutting table 15 to cut out small holes at these designated locations, in order to form the dotted guideline pattern for the field stencil. All of this information is compiled in the fifth step (box 96), to generate cutting instructions to create the field stencil with dotted guidelines. And in the preferred embodiment, the computer 20 transmits the cutting instructions to the) automated cutting table 15 (see box 97), which automatically cuts field stencils in accordance with the instructions (in order to allow for the recreation of the logo/graphic image). Thus, the automated cutting table 15 will generate a pattern of holes/apertures (whose shape could include half moons, semi-circles, circles, triangles, slashes, etc.) allowing for the reproduction of the line drawing.

While the cutting instructions could be implemented by hand, the preferred embodiment takes advantage of additional efficiencies available by extending the automated process further to include the stencil cutting process. Thus, in the preferred embodiment, the cutting instructions from the computer 20 automatically direct the automated cutting table 15 in the creation of the field stencil(s). These instructions control the operations of the automated cutting table 15, which is designed specifically to be used as part of an integrated and automated field stencil creation process. So in accordance with the instructions from the compute 20, the automated cutting table 15 will draw the appropriate length of sheet material 80 and cut the dotted guideline apertures into the sheet material 80.

While field stencils can be made of any sheet material 80 (whether flexible or rigid), the preferred sheet material 80 would be flexible and fairly lightweight (for ease of transport), as well as fairly durable (so that it will not be damaged during transport and/or use). The preferred sheet material 80 comprises approximately 4-8 mil polyethylene plastic. Obviously, other materials would also function, including sheets of plywood, other plastics, cardboard, vinyls, paper, and other rolled or sheet products (so long as the cutting implement 65 is sufficiently strong and durable to repeatedly cut through the material).

Figure 2:
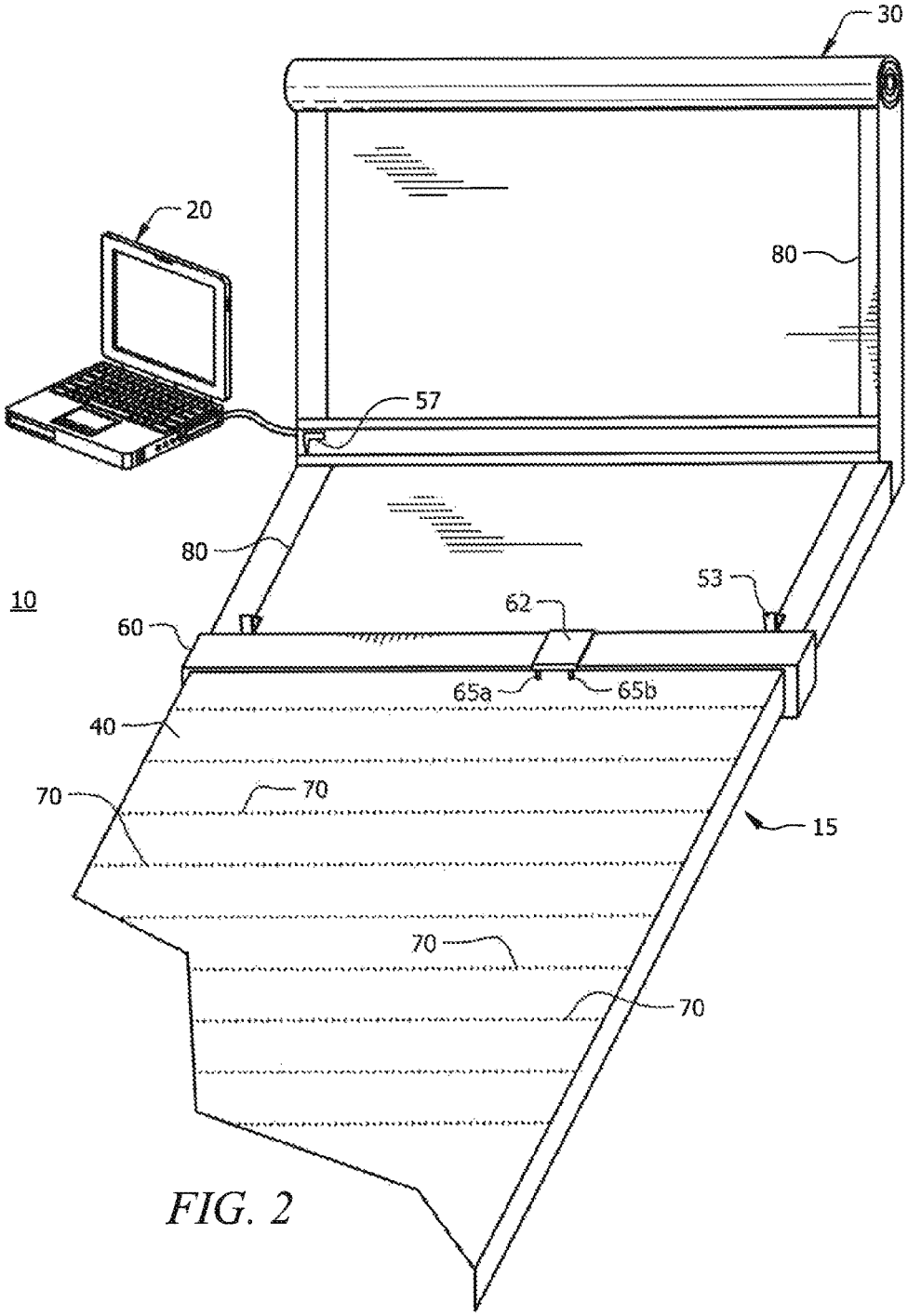
FIG. 2 is an isometric drawing of the preferred embodiment of the ACSCFS.
Figure 3:
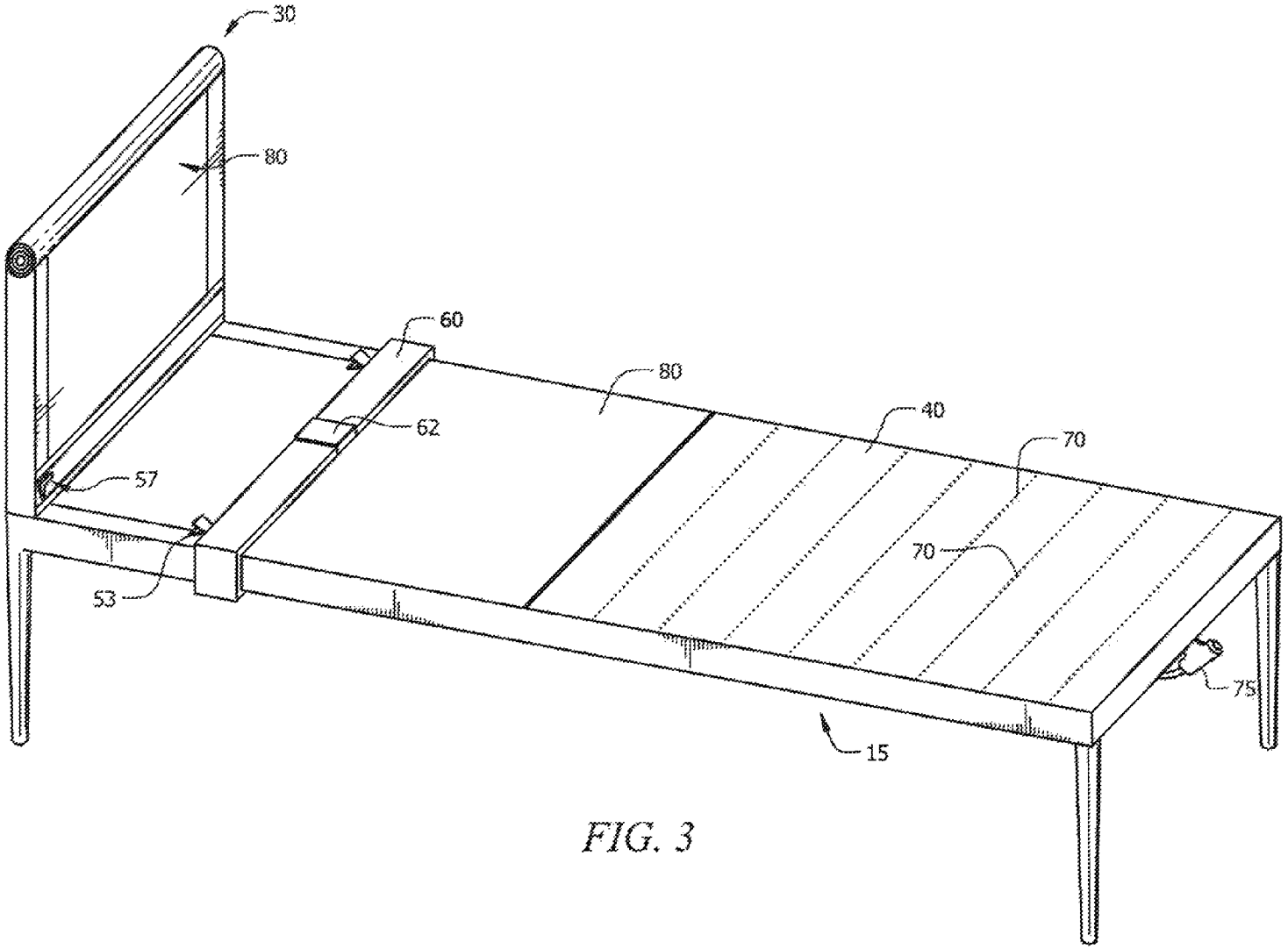
FIG. 3 is an isometric drawing of the preferred embodiment of the Automated Cutting Table.

FIG. 2 illustrates the preferred embodiment of the ACSCFS 10. At its core, the ACSCFS 10 comprises a computer system 20 and an automated cutting table 15. FIG. 3 further illustrates the automated cutting table 15 of the preferred embodiment from a different perspective. The computer system 20 could be a single computer, or several computers could be used in conjunction. Likewise, the computer system 20 could be one or more data processor units specifically designed for the precise purposes of the ACSCFS 10, or it could employ one or more general computers with software enabling the ACSCFS 10 functions. The preferred embodiment uses a general computer with specialized software. The automated cutting table 15 typically further comprises a means for storing sheet material (Le, for holding raw/unused stencil sheet material ready in preparation for the cutting process), a cutting surface 40, a means for placing stencil sheet material onto the cutting surface, a means for holding stencil sheet material against the cutting surface, and a means for cutting stencil sheet material, The means for storing sheet material is designed to hold a reserve of stencil sheet material 80, so that when the computer 20 transmits cutting instructions to the automated cutting table 15, the ACSCFS 10 will have the necessary raw materials on hand to automatically (or manually) begin the stencil creation process. In the preferred embodiment, the means for storing sheet material comprises a roller mechanism 30, on which a roll of plastic sheet material 80 is mounted (allowing the sheet material 80 to be drawn of very simply). Obviously other alternatives exist, including by way of example, a bin with folded sheet material 80 located beneath the table, or placing sheet material 80 on the cutting surface 40 by hand. The cutting surface 40 is typically hard and flat, resembling a large cutting table. The cutting surface 40 in the preferred embodiment is designed to be quite large, so that many standard field stencils can be reproduced using a single stencil sheet (which must fit onto the cutting table surface 40). Ideally, the larger the cutting table surface 40, the better (although of course, the device would function with a smaller cutting table, simply requiring the combination of multiple field stencils for most images). Typically, the preferred embodiment of the cutting surface 40 is rectangular, approximately 16' by 100'. Obviously alternate sizes and shapes would function, so long as a surface is provided for cutting. By way of example, it is possible to use a smaller area as the cutting surface 40, if the stencil sheet material 80 is moved during the cutting process to ensure the necessary backdrop.

The means for placing stencil sheet material onto the cutting surface is designed to draw unused stencil sheet medium material 80 from the means for storing sheet material, and to place it onto the cutting surface 40. It draws a sufficient amount of stencil sheet material 80 in accordance with the instructions from the computer 20, so that a properly sized field stencil can be created. In the preferred embodiment, the means for placing stencil sheet material onto the cutting surface comprises a gantry bar 60 (which straddles the cutting table surface and is motorized to move along the length of the cutting table surface) with a gripper mechanism 53. Initially, the gantry bar 60 is located all the way on one side of the cutting surface 40 (typically nearest the roller 30). Upon receiving instructions from the computer 20, the gripper mechanism 53 grips the stencil sheet material 80, and the gantry bar 60 moves out away from the end of the cutting table the appropriate distance. As it moves, it pulls stencil sheet material 80 off of the roller 30, so that the stencil sheet material 80 extends from the end of the cutting table to the gantry bar 60. Obviously alternatives exist, including by way of example, the use of a conveyor belt atop the cutting table (in conjunction with the application of tape or clamps), or conveyor strips on each side of the cutting table with some sort of gripper mechanism.

The means for holding stencil sheet material against the cutting surface is designed to hold the stencil sheet material 80 flat and tight against the cutting surface 40, in order to enable a good, accurate cut. In the preferred embodiment, the means for holding stencil sheet material against the cutting surface comprises a vacuum system. In essence, the cutting table has a series of small apertures 70 spread across its surface. These apertures 70 are connected to a vacuum pump 75, such that when the vacuum pump 75 is activated, the stencil sheet material 80 stretched atop the cutting table surface 40 is sucked downward, pulled tight, and held firmly in place. Obviously alternatives exist, including by way of example a mechanical means for physically pulling the sheet material down onto the table, or a means for physically weighting or locking the sheet material in place on the table.

Finally, the means for cutting is designed to use the instructions provided by the computer 20 to cut a dotted guideline stencil pattern into the sheet material 80. In actuality, of course, "cutting" is only the most obvious manner of removing sheet material, and any manner of removing designated sections of sheet material 80 in order to form guideline apertures would function (for example, it could also he possible to burn, punch, or etch aperture openings). And obviously, any number of cutting implements 65 could be used, so long as they are sufficiently powerful and durable for repeated cutting on the chosen stencil sheet material 80 (as well as sufficiently mechanically mobile to generate the necessary cuts). In the preferred embodiment, the cutting implement 65 mounts some sort of cutting element 65*b* on an automated gantry or, alternatively, a mechanized arm. The preferred embodiment mounts the cutting element 65*b* on the same mechanized gantry 60 as is used to move the gripper mechanism 53 along the length of the automated cutting table 15 (and which straddles the cutting table surface 40 and is motorized to move along the length of the cutting table surface 40). There is a motorized carriage element 62 mounted on the gantry 60. The cutting element 65*b* of the preferred embodiment is specifically mounted on this carriage 62, allowing for movement of the cutting element 65*b* back and forth along the gantry 60. Movement of the cutting element 65*b* is controlled by the instructions from the computer 20, based on the position of the cutting element 65*b* on the cutting table surface 40 (essentially using a Cartesian grid system). Thus, the mechanized gantry's 60 movement along the length of the table provides one coordinate direction for the cutting implement, while the movement of the carriage 62 back and forth along the gantry 60 provides the second coordinate direction. So, in the preferred embodiment, the movements of the cutting element 65*b* are controlled in a manner very similar to that used for large-scale industrial plotters.

The cutting element 65*b* in the preferred embodiment is typically either a cutter wheel or a fixed drag blade. Obviously, other cutting alternatives exist, including by way of example, a laser, a punch die, a water jet, a drill bit router, or a reciprocating blade. Likewise, other means for mounting and moving the cutting element 65*b* exist, including by way of example a mechanized arm or even a fixed mount (in which the sheet material 80 would be moved with respect to the cutting element 65*b*). Thus, in the preferred embodiment, the mechanized gantry 60 (with its motorized carriage 62) moves the cutting element 65*b* as instructed by the computer 20, to cut guideline holes in the stencil sheet material 80 in order to create the field stencil pattern.

It should also be noted that while not required, the preferred embodiment further includes a plotter pen 65*a* located on the carriage 62 along with the cutting element 65*b*. This optional element allows the ACSCFS 10 to plot the line drawing of the logo/graphic image onto the sheet first, before switching to the cutting element 65*b* in order to cut the dotted guideline apertures in the stencil sheet material 80 (along the drawn lines). While this optional element is certainly not necessary, it is sometimes helpful in allowing for quick visual inspection of the stencil in post-production. It may also assist in orienting multiple field stencils (aka multiple-piece field stencils), when the logo/image to be created is so large that it will not fit on a single stencil sheet (i.e. the logo/image is larger than the cutting surface 40).

The preferred embodiment of the automated cutting table 15 further comprises an optional cutting blade 57, which is mounted at the end of the automated cutting table 15 nearest the roller 30 for the purpose of cutting the stencil sheets free upon completion of the stencil cutting process. In the preferred embodiment, the gantry bar 60 pulls the sheet material 80 out from the roller 30 so that it lays on the cutting table surface 40 in preparation for the process of cutting dotted guideline apertures. The gripper mechanism 53 grabs the free end of the sheet material 80, and the gantry bar 60 moves out away from the end of the automated cutting table 15 sufficiently to draw the necessary amount of sheet material. Once the necessary length of sheet material 80 has been drawn onto the table, the cutting blade 57 frees the sheet material 80 from the roll (in order to create the properly sized stencil sheet). Then in the preferred embodiment, the gantry bar 60 centers the sheet material 80 on the table (although this may be unnecessary, depending upon how the device is zeroed). After the automated cutting table 15 cuts the stencil pattern, the gantry bar 60 returns to its original position. In the preferred embodiment the gripper mechanism 53 automatically grabs the loose end of the sheet material 80 off the roll 30 in preparation for the next stencil cutting operation. In the preferred embodiment, the cutting blade 57 is mechanized to run on a track on the end of the automated cutting table 15, so that it automatically cuts the sheet material free once the gantry bar 60 draws the proper amount of material. Obviously, other automated cutting means could be used to free the formed stencil sheet. Likewise, the stencil could be cut free manually, although automating the process is preferred since it speeds the entire stencil cutting operation.

In creating dotted guideline patterns for field stencils, apertures of several different sizes and shapes could easily be used so long as the apertures in the stencil sheet are sufficiently large so that when paint is applied to the stencil aperture area, the dotted guideline pattern will be adequately visible (on the field surface beneath the stencil) for reproduction. Of course, the apertures must not be too large or too closely spaced, however, since the field stencil needs to retain sufficient strength so that it will be durable enough so that it will not be damaged during routine handling. Thus, ideally the apertures cut in the field stencil will be large enough to leave good visible markings, but will be small enough and spaced apart sufficiently so that the stencil sheet material 80 will not tear during handling. Obviously, the exact specifications will depend to a large degree on the type of sheet material 80 used, as well as the size of the stencil being created.

While the apertures formed in the stencil sheet may be any shape (such as triangles, semi-circles, circles, squares, etc.), in the preferred embodiment, the apertures in the stencil sheet are arc shaped (similar to a semi-circle), since this shape provides good surface area for paint coverage while also providing a fiat side to allow for clear representation of the lines of the logo graphic image (i.e. it allows the line drawing to be easily reproduced). It would also be possible to use multiple aperture shapes, with one shape designating standard lines while another marks corners. For example, a triangle could be used to denote a 90 degree angle (i.e. a sharp corner). In the preferred embodiment, aperture size and spacing depends upon the size of the final logo/graphic image being recreated (as smaller images require smaller holes spaced closer together). Aperture size and spacing is typically uniform throughout a field stencil, unless multiple images are being re-created on a single stencil sheet (and one image is larger than the other).

In the preferred embodiment, once the apertures (for the dotted guideline pattern) are cut into the stencil sheet material 80 according to the cutting instructions, a final, optional step can further be employed in order to make the field stencil more user-friendly. In this step, the area around each aperture (and possibly within the lines which indicate a color boundary) would be painted with the appropriate color, to indicate the color zone that each particular dotted guideline represents. This step simplifies actual use of the field stencil by color-coordinating the apertures, so that users will be able to readily identify the correct color of paint to use for each aperture. This step can be performed manually, in post-production., or it can be performed automatically as part of the ACSCFS 10 process if the unit is set up to handle paint For such an automatic unit, the ACSCFS 10 device would further include a spray painter, attached to the mechanized gantry 60 of the cutting implement 65 in the preferred embodiment (and able to draw from several different paint sources). The unit would use the color information originally decoded from the color image by the computer 20 to generate further instructions that would include the paint color directions for each aperture (since the line drawing used to place the apertures would include color information based on the original color recognition technology used to create the line drawing).

In the preferred embodiment, the entire ACSCFS 10 process is driven by a standard computer 20 using software. The computer 20 can receive the logo/graphic image in several standard formats (from several standard types of input devices), but the preferred embodiment typically uses a graphic image file transmitted via e-mail. Typically, vector file types, such as Adobe Illustrator (ai) or Encapsulated Postscript (eps) are used. In the preferred embodiment, the graphic image file is then opened and manipulated using available programs such as Corel Draw (for converting the color image into a linear drawing), Optitex (for correcting the linear drawing into final form and adding aperture cut locations), and Easicut 2000 (for directing the actions of a plotter-type device). And while aperture cut locations could be placed manually, such a process is time consuming (even using a computer); thus the preferred embodiment uses specially designed software to place aperture cut locations within the line drawing.

While the cutting machinery software used to operate the preferred embodiment of the automated cutting table 15 is also vector-type, it was developed separately from the graphics industry and may not recognize the vector files created by standard graphics software. Thus, a conversion process may also be necessary to ensure that the vector files from the computer 20 of the preferred embodiment communicate the information of the cutting instructions properly to the preferred embodiment of the ACSCFS automated cutting table 15. It should also be noted that, while transformation of the color image into a line drawing occurs using color recognition software in the preferred embodiment, it would also be possible to use a separate color recognition scanner, or other such color recognition technology. All of these operations may be performed on a single computer, or they can be performed on multiple computers, with the files transferred between computers using disk or other means.

So, the automated stencil cutting process works in conjunction with the ACSCFS 10 to greatly improve the process of making field stencils. In the preferred embodiment, the client typically e-mails a graphic image file of the color logo image that they wish to be reproduced, along with details about the size and number of stencils needed. The graphic image file is converted into a line drawing, using color recognition technology. A scaling factor is applied, so that the field stencil will be the correct size. The dotted guideline aperture locations are then placed, and the instructions for creating the field stencil are generated using this information.

In the preferred embodiment, the instructions for creating the field stencil are transmitted to the automated cutting table 15, which then produces the field stencil in accordance with the instruction pattern (i.e. the computer 20 controls field stencil production on the automated cutting table 15). The gripper mechanism 53 grabs the sheet material 80, the gantry bar 60 pulls the necessary amount of raw stencil sheet material 80 (typically 4-8 mil plastic) from the roller 30 onto the cutting surface 40, and the sheet material 80 is cut free from the roll 30 and properly placed on the cutting surface 40 (depending on the zero coordinates). The vacuum pump 75 activates to hold the stencil sheet material 80 securely in place on the cutting surface 40. Then, the gantry 60 (with the cutting element 65h mounted on a carriage 62) is activated in accordance with the instructions from the computer 20. In the preferred embodiment, the plotter pen 65*a* on the mechanized gantry 60 first draws the line drawing, before the cutting element 65*b* cuts the apertures as directed by the computer 20 (to create the dotted guideline hole pattern using the cutting instructions with the aperture location coordinates). Once the entire dotted guideline pattern has been completed, the vacuum pump 75 is deactivated (and optionally, the apertures may be painted with the appropriate colors to provide additional guidance to the end-user of the field stencil). The completed field stencil is ready for use. If multiple field stencils will be used together to form a single image, each section can be assembled into the whole (typically using tape). The completed field stencil may be finished by painting the apertures and adding grommets.

It should be noted that the proper placement of sheet material 80 on the cutting surface 40 (assuming that the stencil sheet being created is shorter than the length of the cutting table surface 40) depends on the location chosen to serve as the origin. In other words, in configuring the ACSCFS 10 device, basically any location on the cutting surface could be selected as the zero coordinate point. While the preferred embodiment typically centers the sheet material 80 on the cutting table surface 40, the zero point could easily be set at either end of the automated cutting table 15 as well.

It should also be noted that, while the preferred embodiment typically generates one field stencil on a single sheet of stencil sheet material 80, multiple smaller stencil patterns could be produced on one sheet of stencil sheet material 80 (based on the set up provided by the operator). Furthermore, while the preferred embodiment cuts only a single field stencil at a time, it is possible for the ACSCFS 10 to automatically cut multiple sheets of stencil sheet material 80 at once. If for example, multiple sheets of stencil material 80 were stacked atop one another on the cutting surface 40, then more than one field stencil could be simultaneously created. This layering approach is not currently preferred, however, since alignment and precision concerns are multiplied by stacking sheets of material.

Figure 4A:
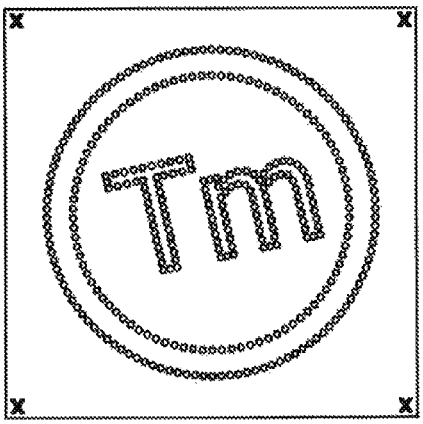
FIG. 4 is an illustrated (multi-picture) diagram, showing the method of using a field stencil to recreate a multi-color logo image.
Figure 4B:
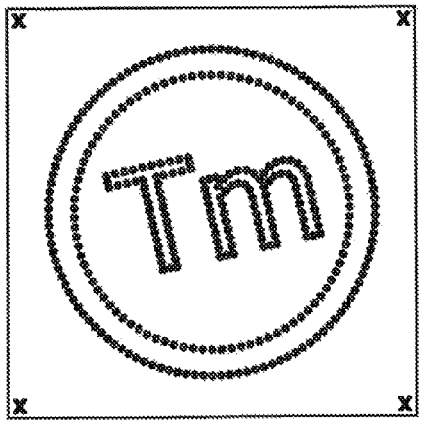
Figure 4C:
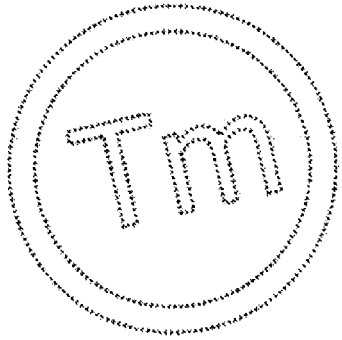
Figure 4D:
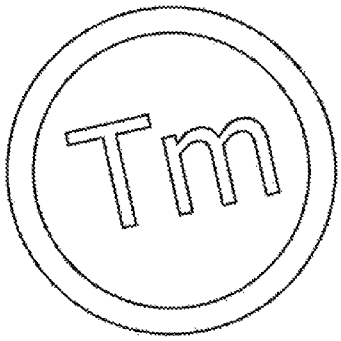
Figure 4E:
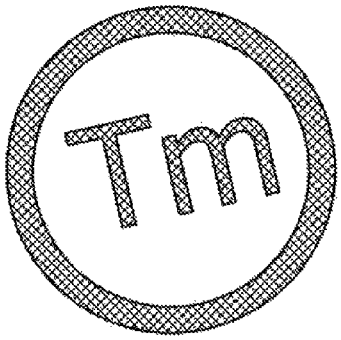

Once a field stencil has been created, it is then ready to be used to recreate the original logo/graphic image on a grass field (or some such other surface). Implementation is fairly straightforward, and is graphically illustrated in FIG. 4. First, as shown in FIG. 4A, the field stencil is taken to the appropriate location, and staked out in place (at the spot where the logo is desired, in the desired orientation). Then, the appropriate color of paint is applied to each of the guideline hole apertures (typically sprayed, rolled, or brushed), in order to mark the dotted guideline image onto the field beneath the stencil (see FIG. 4B). When the field stencil is removed, a dotted guideline pattern for the logo/graphic image should be in place on the field (as in FIG. 4C). The dotted guidelines are then connected (see FIG. 4D), using the appropriate colors of paint, and then the areas between the solid color guidelines are filled in with the appropriate colors of paint (see FIG. 4E). In this way, a field stencil can be used to quickly and effectively recreate a multi-color logo upon a field or other surface.

So, the present invention of the ACSCFS 10 is a preferred embodiment for implementing the preferred version of the method, developed by applicants and described in detail herein, for automatically creating field stencil logos. The specific embodiments, methods, and uses set forth herein are merely illustrative examples of the preferred embodiment of the ACSCFS 10 invention and are not intended to limit the present invention in any way. A person skilled in the field will understand and appreciate additional and alternative embodiments, methods, steps, and uses, as well as equivalents, which are also included within the scope of the present invention. Furthermore, any patents listed herein by way of example are specifically incorporated by reference. The scope of the invention is more fully defined in the following claims, and the only limits to the scope of the invention are those set forth explicitly in the claims below.

What is claimed is:

1. A method for creating field stencils for reproducing a multi-color image onto a field surface, using an automated cutting table with flexible sheet material, comprising the steps of:

converting by computer the multi-color image into a line drawing of the multi-color image;

scaling by computer the line drawing;

automatically placing by computer a plurality of guideline aperture cut location coordinates for each line of the line drawing;

designating by computer each of the plurality of guideline aperture cut location coordinates as one of the following shapes: approximately semi-circular, approximately triangular, approximately circular, and approximately square;

generating by computer cutting instructions to the automated cutting table;

drawing sheet material onto the automated cutting table; and cutting a plurality of guideline apertures in the sheet material using the automated cutting table in accordance with the cutting instructions;

wherein the cutting instructions are based on the guideline aperture cut location coordinates and direct the automated cutting table to cut an aperture of the designated shape for each guideline aperture cut location coordinate; and wherein each line in the line drawing represents a color boundary within the multi-color image; wherein the shapes for each guideline cut aperture location coordinate are either approximately triangular or approximately semicircular guideline apertures, wherein the guideline apertures cut in the sheet material are either approximately semicircular apertures or approximately triangular apertures, and wherein the approximately triangular apertures are located to denote a sharp angle in the line drawing.

2. A method for creating field stencils for reproducing a color image, using an automated means for cutting sheet material, comprising the steps of:

translating the color image into a line drawing of the multi-color image;

scaling the line drawing;

automatically placing a plurality of guideline aperture cut location coordinates for each line within the line drawing;

generating cutting instructions to the automated cutting means;

providing sheet material; and cutting guideline apertures in the sheet material using the automated cutting means in accordance with the cutting instructions;

wherein the cutting instructions are based on the guideline aperture cut location coordinates and direct the automated cutting means to cut one guideline aperture for each guideline aperture cut location coordinate; wherein the shapes for each guideline cut aperture location coordinate are either approximately triangular or approximately semicircular guideline apertures, wherein the guideline apertures cut in the sheet material are either approximately semicircular apertures or approximately triangular apertures, and wherein the approximately triangular apertures are located to denote a sharp angle in the line drawing.

3. The method of claim 2, wherein the guideline apertures comprise approximately semicircular apertures, and wherein each semicircular guideline aperture comprises a flat side and a curved side, with the flat side of the semicircular guideline aperture denoting a portion of one line in the line drawing to indicate a color zone boundary.

4. The method of claim 2, wherein said guideline apertures comprise approximately triangular apertures to denote intersection of two lines in the line drawing.

5. The method of claim 2, wherein said guideline apertures comprise approximately circular apertures.

6. The method of claim 2, wherein said guideline apertures comprise approximately square apertures.

7. The method of claim 2, wherein said guideline apertures comprise two or more shapes.

8. The method of claim 2, wherein each of said guideline apertures is either a semicircle or a triangle, wherein triangular guideline apertures are located to denote a sharp angle in the line drawing, and wherein each semicircular guideline aperture comprises a flat side and a curved side, with the flat side of the semicircular guideline aperture denoting a portion of one line in the line drawing to indicate a color zone boundary.

9. The method of claim 2, wherein the plurality of guideline aperture cut location coordinates are approximately uniformly spaced along the lines of the line drawing.

10. A method for creating a field stencil based on a color image, comprising the steps of:

converting the color image into a line drawing of the multicolor image;

placing a plurality of guideline aperture cut location coordinates within the line drawing; and generating cutting instructions for automated cutting of sheet material to form a stencil;

wherein the cutting instructions are based on the plurality of guideline aperture cut location coordinates; and wherein each guideline aperture cut location coordinate corresponds to a single guideline aperture located along a line within the line drawing; wherein the shapes for each guideline cut aperture location coordinate are either approximately triangular or approximately semicircular guideline apertures, wherein the guideline apertures cut in the sheet material are either approximately semicircular apertures or approximately triangular apertures, and wherein the approximately triangular apertures are located to denote a sharp angle in the line drawing.

11. The method of claim 10, further comprising designating one or more of the plurality of guideline aperture cut location coordinates as semicircular guideline aperture locations, and wherein the cutting instructions direct an automated cutting means to cut semicircular guideline apertures in the sheet material at the designated locations.

12. The method of claim 10, further comprising designating one or more of the plurality of guideline aperture cut location coordinates as triangular guideline aperture locations, and wherein the cutting instructions direct an automated cutting means to cut approximately triangular guideline apertures in the sheet material at the designated locations.

13. The method of claim 12, wherein triangular guideline aperture locations denote intersection of two lines in the line drawing.

14. The method of claim 12, further comprising designating one or more of the plurality of guideline aperture cut location coordinates as semicircular guideline aperture locations, and wherein the cutting instructions direct the automated cutting means to cut approximately semicircular guideline apertures in the sheet material at such designated locations; and wherein each approximately semicircular guideline aperture comprises a flat side and a curved side, with the flat side of the approximately semicircular guideline aperture denoting a portion of the line drawing to indicate a color zone boundary.

15. The method of claim 10, further comprising designating each of the plurality of guideline aperture cut location coordinates as one of a plurality of shapes.

16. The method of claim 15, wherein the cutting instructions direct an automated cutting means to cut the designated shape of guideline aperture in the sheet material for each of the plurality of guideline aperture cut location coordinates, and wherein the guideline apertures are approximately uniformly sized and spaced on lines of the line drawing.

17. The method of claim 10, further comprising:

drawing sheet material onto an automated cutting table; and cutting guideline apertures in the sheet material using the automated cutting table in accordance with the cutting instructions;

wherein the cutting instructions direct the cutting table to cut one guideline aperture for each guideline aperture cut location.

18. The method of claim 17, further comprising plotting the lines of the line drawing onto the drawn sheet material.

19. The method of claim 17, further comprising painting an area of the sheet material around each guideline aperture with an appropriate color to denote color zone boundaries in the color image for subsequent use of the field stencil.

* * * * *